US009400472B2

(12) United States Patent
Ishizaki

(10) Patent No.: US 9,400,472 B2
(45) Date of Patent: Jul. 26, 2016

(54) BELT CONVEYANCE APPARATUS INCLUDING A BELT AND A DRIVING ROLLER IN AN IMAGE FORMING APPARATUS OR SYSTEM

(71) Applicant: Yusuke Ishizaki, Yamatoshi (JP)

(72) Inventor: Yusuke Ishizaki, Yamatoshi (JP)

(73) Assignee: RICOH COMPANY, LTD., Tokyo (JP)

( * ) Notice: Subject to any disclaimer, the term of this patent is extended or adjusted under 35 U.S.C. 154(b) by 68 days.

(21) Appl. No.: 13/956,037

(22) Filed: Jul. 31, 2013

(65) Prior Publication Data

US 2014/0037300 A1 Feb. 6, 2014

(30) Foreign Application Priority Data

Jul. 31, 2012 (JP) ..... 2012-170634
Jul. 23, 2013 (JP) ..... 2013-152864

(51) Int. Cl.
*G03G 15/00* (2006.01)
*G03G 15/16* (2006.01)

(52) U.S. Cl.
CPC ..... *G03G 15/65* (2013.01); *G03G 15/1615* (2013.01); *G03G 15/5054* (2013.01)

(58) Field of Classification Search
CPC ... G03G 15/00; G03G 15/65; G03G 15/1615; G03G 15/5054
USPC ..... 399/361, 363–365, 381, 388, 394–397, 399/167, 301
See application file for complete search history.

(56) References Cited

U.S. PATENT DOCUMENTS 7,460,820 B2 * 12/2008 Okabe ..... G03G 15/0131 399/167
8,000,622 B2 8/2011 Ishizaki et al.
8,326,549 B2 12/2012 Ishizaki et al.
8,474,816 B2 7/2013 Ishizaki et al.
2004/0197111 A1 * 10/2004 Kuroda ..... G03G 15/161 399/66
2006/0110189 A1 * 5/2006 Matsuda ..... G03G 15/0194 399/301
2006/0165442 A1 * 7/2006 Kobayashi ..... G03G 15/1685 399/301
2006/0184258 A1 * 8/2006 Matsuda ..... G03G 15/0131 700/56
2006/0275056 A1 * 12/2006 Matsuda ..... G03G 15/161 399/301
2009/0148185 A1 * 6/2009 Kudo ..... G03G 15/0131 399/167
2009/0190972 A1 * 7/2009 Ohkubo ..... G03G 15/0131 399/301
2009/0238613 A1 * 9/2009 Ueda et al. ..... 399/301
2010/0054768 A1 * 3/2010 Hashimoto ..... G03G 15/0194 399/38
2010/0082163 A1 * 4/2010 Masuda ..... G03G 15/161 700/279
2011/0026994 A1 * 2/2011 Ryu ..... G03G 15/1615 399/396
2012/0268793 A1 * 10/2012 Seki ..... G03G 15/0131 358/1.18

* cited by examiner

*Primary Examiner* — Nguyen Ha
(74) *Attorney, Agent, or Firm* — Oblon, McClelland, Maier & Neustadt, L.L.P.

(57) ABSTRACT

A belt conveyance apparatus including a driving roller to rotate and drive a belt, a first detector to detect surface speed of the belt, and a second detector to detect rotation speed of the driving roller. There is a first calculator to calculate a first deviation from target speed based on the surface speed and the target speed, and a memory to store a correction value corresponding to the first deviation. A second calculator calculates a second deviation from the target speed corrected by the first deviation based on the target speed, the first deviation and the rotation speed of the driving roller. A controller controls the rotation speed of the driving roller based on the second deviation. There is also a switch to switch the first deviation to the correction value stored in the memory when controller judges that the first detector is abnormal.

5 Claims, 14 Drawing Sheets

| TEMPERATURE RANGE | MEMORY ADDRESS |
|---|---|
| - 20°C | E |
| 20 - 30°C | F |
| 30 - 40°C | G |
| 40°C - | H |

| TEMPERATURE RANGE | MEMORY ADDRESS |
|---|---|
| - 20°C | I |
| 20 - 30°C | J |
| 30 - 40°C | K |
| 40°C - | L |

BELT CONVEYANCE APPARATUS INCLUDING A BELT AND A DRIVING ROLLER IN AN IMAGE FORMING APPARATUS OR SYSTEM

CROSS REFERENCE TO RELATED APPLICATIONS

The present application claims priority to Japanese Patent Application 2013-152864, filed on Jul. 23, 2013, which claims priority to Japanese Patent Application 2012-170634, filed on Jul. 31, 2012, the entire contents of both are incorporated herein by reference.

BACKGROUND OF THE INVENTION

1. Field of the Invention

Embodiments of the present invention relate to a belt conveyance apparatus, an image forming apparatus, and an image forming system.

2. Description of the Related Art

In an apparatus which moves a belt by a driving roller, there is known a technology of controlling the belt surface speed based on detection of two sensors. One sensor of the two sensors detects the rotation speed of the driving roller, and another sensor detects the belt surface speed.

JP-A No. 2004-220006 discloses an image forming apparatus for controlling a belt speed by a secondary control loop which uses a second sensor to detect rotation speed of a driving roller, when a primary control loop which uses a first sensor to detect a belt surface speed is abnormal. When the primary control loop is abnormal because of dirt and there is expansion of the driving roller due to a rising temperature, the image forming apparatus is not controlled accurately. In this case the image forming apparatus needs to stop operation.

SUMMARY OF THE INVENTION

The embodiments of the present invention have been developed in view of the above-described problems of the conventional techniques.

An objective of the embodiments of the present invention is to provide a belt conveyance apparatus, an image forming apparatus and an image forming system that can prevent reduction of accuracy of controlling the belt surface speed when a sensor to detect the belt speed is abnormal.

In one aspect, a belt conveyance apparatus including a driving roller to rotate and drive a belt, a first detector to detect surface speed of the belt, and a second detector to detect rotation speed of the driving roller. There is a first calculator to calculate a first deviation from target speed based on the surface speed and the target speed, and a memory to store a correction value corresponding to the first deviation. There is a second calculator to calculate a second deviation from the target speed corrected by the first deviation based on the target speed, the first deviation and the rotation speed of the driving roller. A controller controls the rotation speed of the driving roller based on the second deviation. There is also a switch to switch the first deviation to the correction value stored in the memory when controller judges that the first detector is abnormal.

The invention can also be used in an image forming system which includes an image forming apparatus.

According to the embodiments of the present invention, the belt conveyance apparatus, the image forming apparatus and the image forming system are provided in order to prevent reducing accuracy of controlling the belt surface speed when a sensor to detect the belt speed is abnormal.

BRIEF DESCRIPTION OF THE DRAWINGS

A more complete appreciation of the invention and many of the attendant advantages will be readily obtained as the same becomes better understood by reference to the following detailed description when considered in connection with the accompanying drawings, wherein.

DETAILED DESCRIPTION OF THE PREFERRED EMBODIMENTS

Hereinafter, an embodiment of the present invention will be explained by describing the image forming system. This invention can be also applied to any image forming apparatus having a belt unit such as a facsimile device, a copier device, a multi-function peripheral, or the like, otherwise than as specifically described herein.

Figure 1:
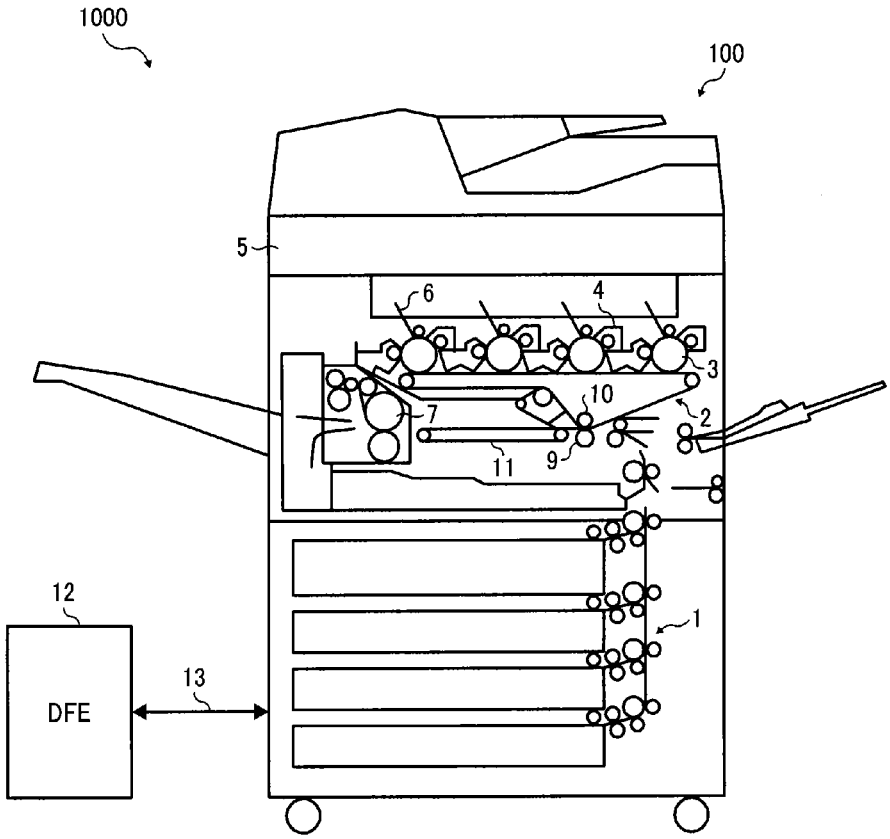
FIG. 1 is a schematic configuration view showing an example of the image forming system which includes an image forming apparatus.

Referring now to the drawings, wherein like reference numerals designate identical or corresponding parts throughout the several views, an image forming system 1000 including an image forming apparatus 100. As shown in FIG. 1, an image forming apparatus 100 according to an embodiment includes a scanner unit 5, an image forming unit 6, a photoconductive unit 3, a developing unit 4, an intermediate transfer unit 2, a feeding unit 1, a conveyance unit 11, and a fixing unit 7. The scanner unit 5 emits light to a document, and reads image data by receiving reflecting light from the document. An image processing unit of the image forming apparatus is implemented as a processor, application specific integrated circuitry and/or other circuitry, and processes the image data using processes such as shading correction, gamma correction, or MTF correction, and sends the image data to the image forming unit 6. The photoconductive drum of the photoconductive unit 3 rotates at constant speed. The image forming unit 6 drives a LD (Laser Diode) corresponding to the image data. The LD emits laser beam to the photoconductive drum, and writes an electrostatic latent image on the photoconductive drum.

The developing unit 4 develops the electrostatic latent image with toner into a toner image. The toner image on the photoconductive drum is transferred to an intermediate transfer belt of the intermediate transfer unit 2. In the case of a full-color copy, four toner images (black, cyan, magenta, and yellow) are transferred to an intermediate transfer belt in succession. The feeding unit 2 feeds a sheet such as paper into the image forming apparatus. The sheet is conveyed to secondary transfer point. There are a secondary transfer roller and a transfer facing roller at on the secondary transfer point. These four toner images are transferred to the sheet between the secondary transfer roller 9 and the transfer facing roller 10. The conveyance unit 11 conveys the sheet on which is transferred toner image to the fixing unit 7. The fixing unit 7 fixes the toner image to the sheet with heat and pressure by a fixing roller and a pressure roller. Then, image forming apparatus 100 discharges the sheet on which the toner image was formed.

The image forming apparatus 100, according to this embodiment, can be connected to a DFE 12 (Digital Front End) via a dedicated communication line 13. The DFE 12 can include a function of Raster image processor (RIP) and generate raster image data based on image data receiving from a PC (Personal Computer). Then, the DFE 12 can send the raster image data to the image forming apparatus 100.

Additionally, the DFE 12 may connect to the image forming apparatus 100 via a network. Alternatively, the DFE 12 may be omitted as an exterior element, and the image forming apparatus 100 may include the function of the DFE inside and generate the raster image data based on the image data received from the PC.

Figure 2:
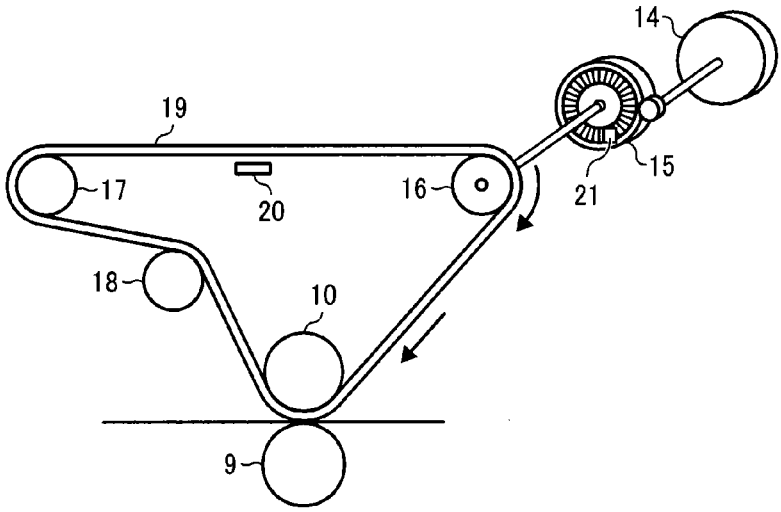
FIG. 2 is a schematic configuration view showing an example of an intermediate transfer unit together with various units of the image forming apparatus.

FIG. 2 is a schematic configuration view showing the intermediate transfer unit 2 together with various units of the image forming apparatus 100 shown in FIG. 1. The intermediate transfer unit 2 includes the intermediate transfer belt 19, a driving roller 16, a following roller 17, the transfer facing roller 10, and a tension roller 18. The intermediate transfer belt 19 is wound around the driving roller 16, the following roller 17, and the transfer facing roller 10. The tension roller 18 applies tension to the intermediate transfer belt 19. The intermediate transfer belt 19 is moved by the driving roller 16 which is rotated by a motor 14. There is a speed reduction mechanism 15 such as gears between the motor 14 and the driving roller 16. The rotation speed of the motor 14 is reduced by the speed reduction mechanism 15, and is transmitted to the driving roller 16.

There is an encoder pattern (belt scale) on almost the entire back surface of the intermediate transfer belt 19. A belt scale sensor 20 detects the belt scale, for example using light which is emitted, reflected off the transfer belt 19, and received by a sensor. The belt scale sensor 20 is an example of the first detecting unit. There is an encoder 21 for detecting the rotation speed of the driving roller 16 on the shaft of the driving roller 16. The encoder 21 may be rotary encoder, and may detect the rotation speed of the driving roller 16 by a disk on the shaft of the driving roller 16 and a sensor detecting the disk. This sensor may operate by detecting reflected light, for example. The encoder 21 is an example of the second detecting unit. The surface speed of the intermediate transfer belt 19 is controlled to be a target speed based on the detection of the belt scale sensor 20 and the detection of the encoder 21.

Figure 3:
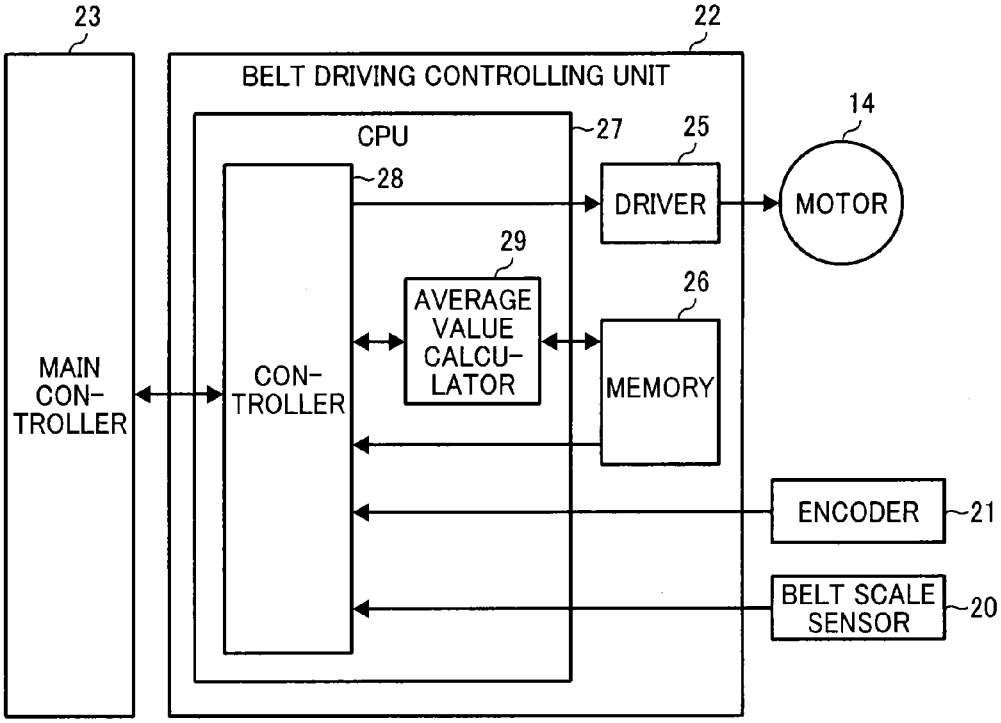
FIG. 3 is a functional block diagram showing an example of a belt driving controlling unit which controls an intermediate transfer belt together with various units of the image forming apparatus according to an embodiment of the present invention.

FIG. 3 is a functional block diagram showing a belt driving controlling unit 22 which controls the intermediate transfer belt 19 together with various units. The belt driving controlling unit 22 includes a driver 25 which drive the motor 14, a memory 26, and a CPU 27. The CPU 27 includes a controller 28 and an average value calculator 29, and controls each part of the belt driving controlling unit 22. The memory 26 stores the average value calculated by the average value calculator 29 or the like.

When a main controller 23 sends a start signal and a rotation direction indication signal or the like to the CPU 27 of the belt driving controlling unit 22, the belt driving controlling unit 22 starts rotation of the motor 14 by the driver 25. The controller 28 calculates based on the detection of the belt scale sensor 20 and the encoder 21. Then, the controller 28 controls the motor 14 so that speed of surface of the intermediate transfer belt 19 is the target speed based on result of calculation.

Figure 4A:
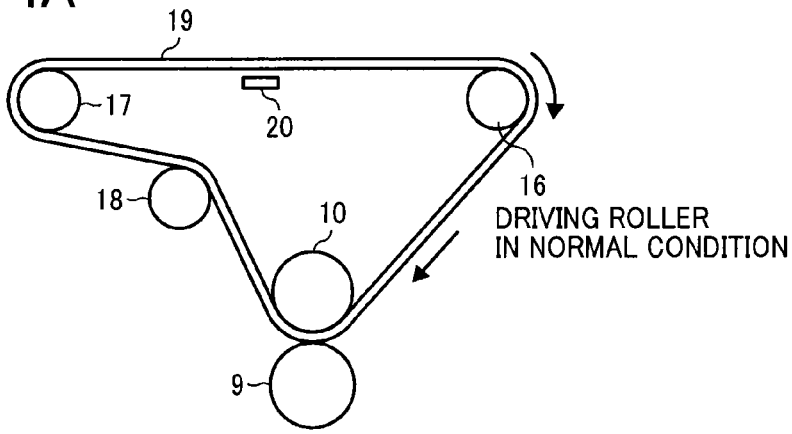
FIGS. 4A-4C are illustrations showing influence in a case that the belt scale sensor does not detect the speed of the surface of the intermediate transfer belt.
Figure 4B:
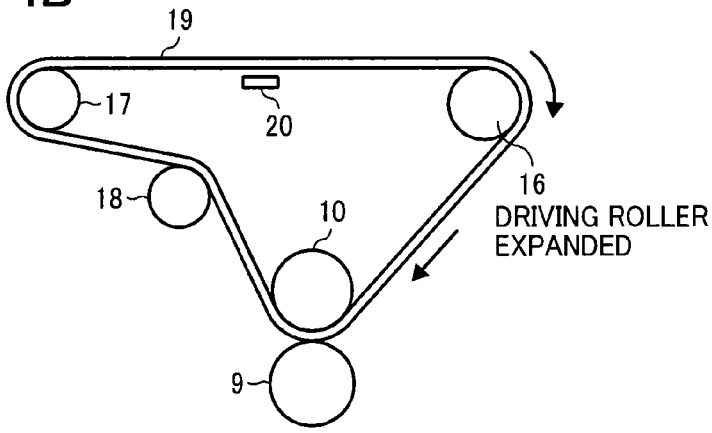
Figure 4C:
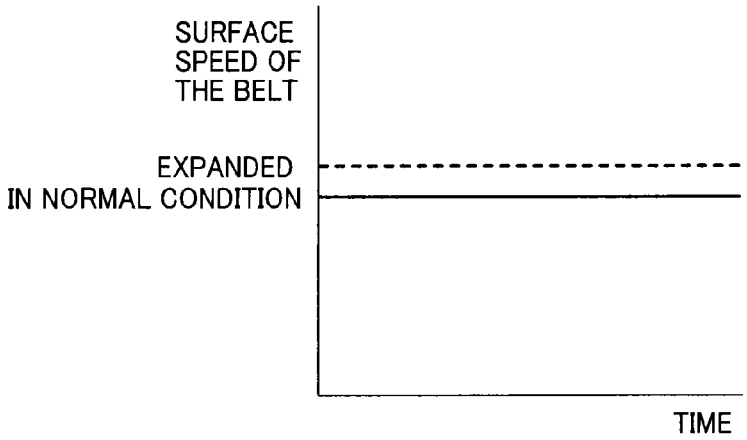

FIGS. 4A-4C are illustrations showing an influence when the belt scale sensor 20 does not detect the speed of surface of the intermediate transfer belt 19 in the prior art. FIG. 4A is an illustration showing the intermediate transfer unit in a normal condition. FIG. 4B is an illustration showing the intermediate transfer unit when the driving roller 16 expands because of rising temperature. FIG. 4C is an illustration showing the speed of the surface of the intermediate transfer belt 19. As shown in FIG. 4C, when the belt scale sensor 20 does not detect the speed of the surface of the intermediate transfer belt 19 and the driving roller 16 expands, and the speed of the surface of the intermediate transfer belt is faster than a normal condition. When the driving roller 16 contracts because of decreasing of temperature, the speed of the surface of the intermediate transfer belt 19 may decrease.

Figure 5:
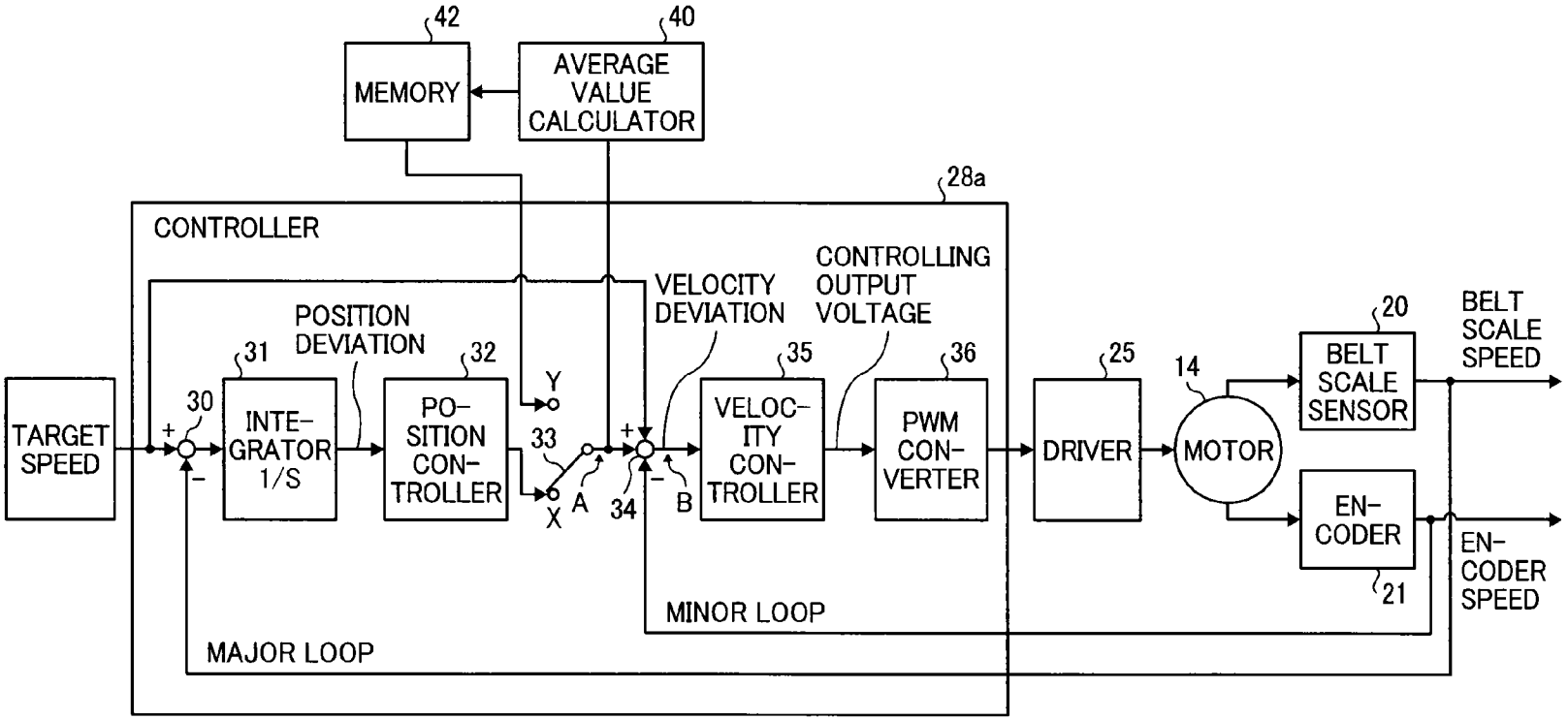
FIG. 5 is a functional block diagram showing an example of a controller together with various units of the image forming apparatus according to a first example of the present invention.

Next, a description will be given of an image forming apparatus of a first example of the present invention. FIG. 5 is a functional block diagram showing a controller 28*a* together with various units of the image forming apparatus according to a first example.

The controller 28*a* corresponds to the controller 28 shown in FIG. 3. As shown in FIG. 5, the controller 28*a* includes a first comparator 30 (the first calculator), an integrator 31, a position controller 32, a switching unit 33, a second comparator 34 (the second calculator), a velocity controller 35, and a PWM converter 36.

The first comparator 30 receives the target speed of the surface of the intermediate transfer belt 19 and the detection of the belt scale sensor 20 which indicates belt scale speed, and calculates a velocity deviation of the belt scale speed from a target speed, for example, using subtraction. Then the first comparator 30 outputs the velocity deviation to the integrator 31. The integrator 31 calculates the position deviation by integrating the velocity deviation, and outputs the position deviation to the position controller 32. The position controller 32 calculates the correction value of the target speed as the speed deviation from the target speed corresponding to the position deviation.

When the belt scale sensor 20 is abnormal, the switching unit 33 switches the input terminal to Y from X. The switching unit 33 may be implemented using any desired technology including a programmed processor, an integrated circuit, circuit components, and/or a combination of these elements. The second comparator 34 receives the target speed, the detection of the encoder 21 (encoder speed), and signal via the switching unit 33, and calculates a velocity deviation. The second comparator 34 outputs the velocity deviation to the velocity controller 35.

The velocity controller 35 controls the output voltage which is output to the motor 14 corresponding to the velocity deviation from the second comparator 34 so that the surface speed of the intermediate transfer belt 19 approaches the target speed. The PWM converter 36 outputs pulses to the driver 25 corresponding to the controlling output voltage.

Additionally, the position controller 32 and the velocity controller 35 may be implemented as one or more general controller which is designed by frequency response based on the motor input voltage, the signal from the encoder, and the signal from the belt scale sensor 20.

Next, a description will be given of an operation of the controller 28*a*. The integrator 31 of the controller 28*a* converts the velocity deviation which was calculated from the belt scale speed and the target speed (first target speed) received from the main controller 23 or CPU 27, to the position deviation. The position controller 32 outputs the correction value corresponding to the position deviation. The sum of the correction value and the target speed (first target speed) is a rotating shaft target speed (second target speed). The velocity deviation is calculated based on the second target speed and the encoder speed. The velocity controller receives the velocity deviation, and outputs the controlling output voltage (indicated value). The PWM converter 36 outputs the pulse corresponding to the controlling output voltage, and drives the driver 25.

When the belt scale sensor 20 is abnormal, the controller 28*a* controls the motor 14 without using the outputs from the position controller 32 by switching the input terminal to the Y position by the switching unit 33. This enables the controller 28*a* to feedback control. Additionally, the loop of using the detection of the belt scale sensor 20 is called major loop (master loop). The loop of using the detection of the encoder 21 is called a minor loop or a slave loop.

Next, a description will be given of an average value calculator and a memory. The average value calculator 40 corresponds to the average value calculator 29 shown in FIG. 3, and calculates the average of the outputs A from the position controller 32 of predetermined period. The memory 42 corresponds to the memory 26 shown in FIG. 3, and stores the average value received from the average value calculator 40. When the belt scale sensor 20 is abnormal because of dirt, for example, the switching unit 33 switches the input terminal from the X position used in normal condition to the Y position used in an abnormal condition, and then the second comparator 34 uses the data stored in the memory 42 as the correction value.

Additionally, the detection method of an abnormal condition may be implemented using a known method such as that disclosed in JP-A No. 2004-271718, which is incorporated by reference.

Figure 6:
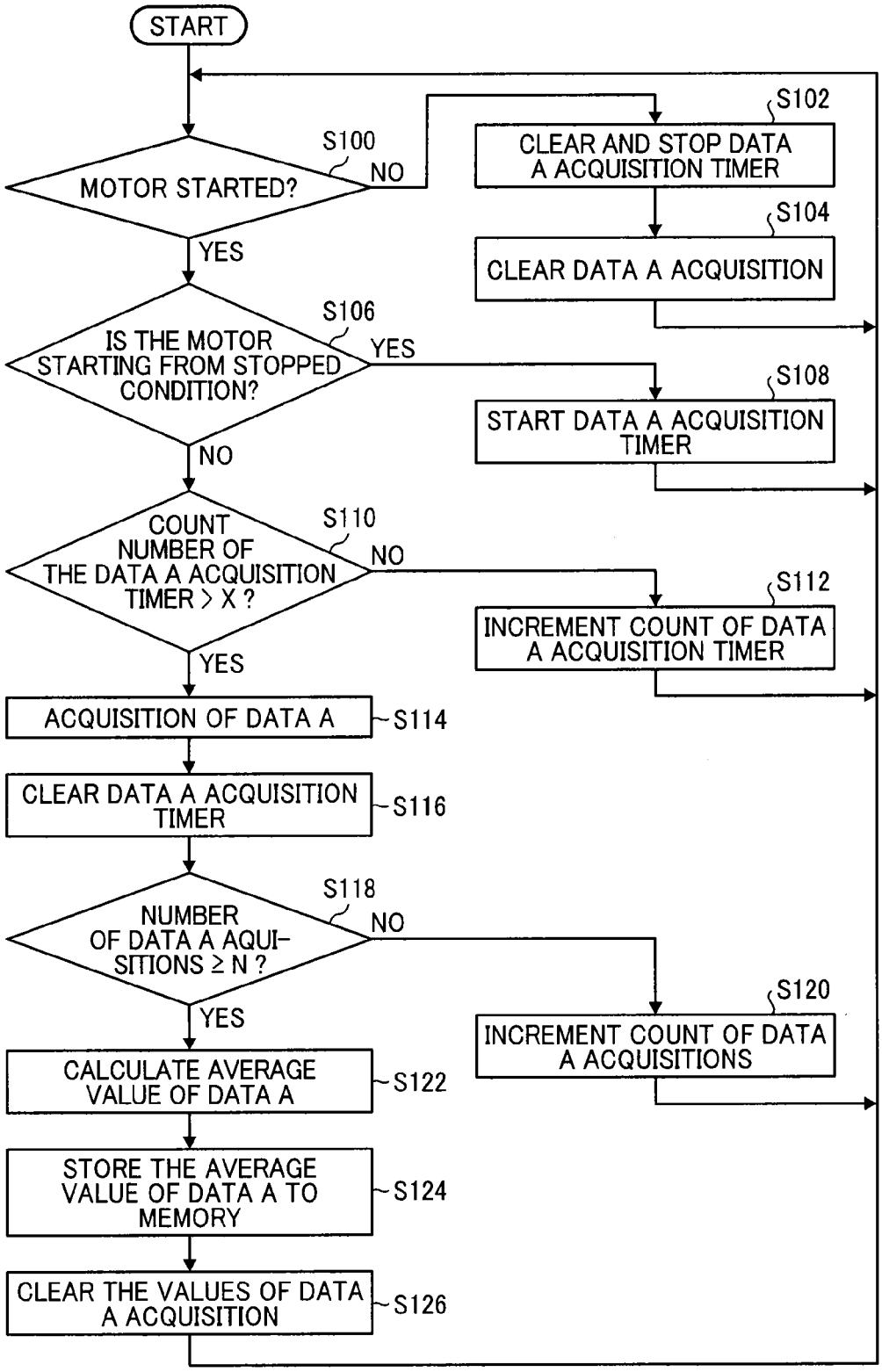
FIG. 6 is a flowchart showing an exemplary operation by the controller according to the first example of the present invention.

FIG. 6 is a flowchart showing an operation by the controller 28*a* of the image processing apparatus 100 according to the first example. As shown in FIG. 6, the controller 28*a* determines if the motor 14 has started or is starting. When the motor has started or is starting (S100: Yes), the controller 28*a* performs the step S106. When the motor does not start (S100: No), the controller 28*a* performs step S102.

In step S102, the controller 28*a* stops a data A acquisition timer which is used to acquire data A, and clears the data A acquisition timer. In step S104, the controller 28*a* clears the number of the data A acquisition.

In step S106, the controller 28*a* determines if the motor is starting from a stopped condition. When the motor is starting from the stopped condition (S106: Yes), the controller 28*a* performs step S108. When the motor is not starting from stopped condition, that is, the motor 14 has started (S106: No), the controller 28*a* performs step S110.

In step S108, the controller 28*a* starts the data A acquisition timer.

In step S110, the controller 28*a* determines if the count number of the data A acquisition timer exceeds X which corresponds to the predetermined period. When the controller 28*a* determines the count number of the data A acquisition timer exceeds X (S110: Yes), the controller 28*a* performs step S114. When the controller 28*a* determines the count number of the data A acquisition timer does not exceed X (S110: No), the controller 28*a* performs step S112.

In step S112, the data A acquisition timer, for example of the controller 28*a*, counts up. In step S114, the controller 28*a* acquires the data A. In step S116, the controller 28*a* clears the data A acquisition timer.

In step S118, the controller 28*a* determines if the number of the data A acquisition exceeds N which is predetermined. When the controller 28*a* determines the number of the data A acquisition exceeds N (S118: Yes), the controller 28*a* performs step S122. When the controller 28*a* determines the number of the data A acquisition does not exceed N (S118: No), the controller 28*a* performs step S120.

In step S120, the controller 28*a* counts up the number of the data A acquisitions.

In step S122, the controller 28*a* calculates the average value of the data A. Additionally, the average value of the data A is an example of a corresponding value of data A. In step S124, the controller 28*a* stores the average data A to the data A storing area of the memory 42. In step S126, the controller 28*a* clears the number of the data A acquisition.

Additionally, the values of X and N can be arbitrary set based on the condition of the intermediate transfer belt 19. Additionally or alternatively, the controller 28*a* can repeat step S100 to step S126.

Figure 7:
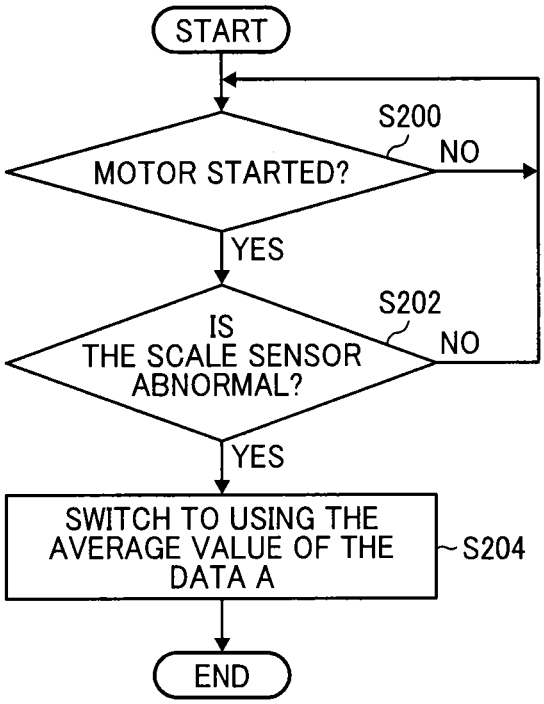
FIG. 7 is a flowchart showing an exemplary operation by the controller of the image forming apparatus according to the first example of the present invention when the belt scale sensor is abnormal.

FIG. 7 is a flowchart showing an operation by the controller 28*a* of the image forming apparatus 100 when the belt scale sensor 20 is abnormal.

As shown in FIG. 7, the controller 28*a* determines if the motor 14 has been started in step S200. When the controller 28*a* determines the motor 14 has been started, the controller 28*a* performs step S202. When the controller 28*a* determines the motor 14 is not started, the controller 28*a* repeats the step S200.

In step S202, the controller 28*a* determines if the belt scale sensor 20 is abnormal. When the controller 28*a* determines that the belt scale sensor 20 is abnormal (S202: Yes), the controller 28*a* performs the step S200. When the controller 28*a* determines that the belt scale sensor 20 is normal (e.g., not abnormal) (S202: No), the controller 28*a* performs step S200. In this way, the controller 28*a* monitors whether the belt scale sensor 20 is abnormal.

In step S204, the controller 28*a* switches the switching unit 33 so that the controlling of the surface speed of the intermediate transfer belt 19 is performed using the average value of the data A. That is, the controller 28*a* uses the average value of the data A as the outputs from the major loop. This enables a reduction in the fluctuation of the surface speed of the intermediate transfer belt 19 because of thermal expansion of the driving roller 16 when the belt scale sensor 20 is abnormal and the detection of encoder 21 is used.

Figure 8:
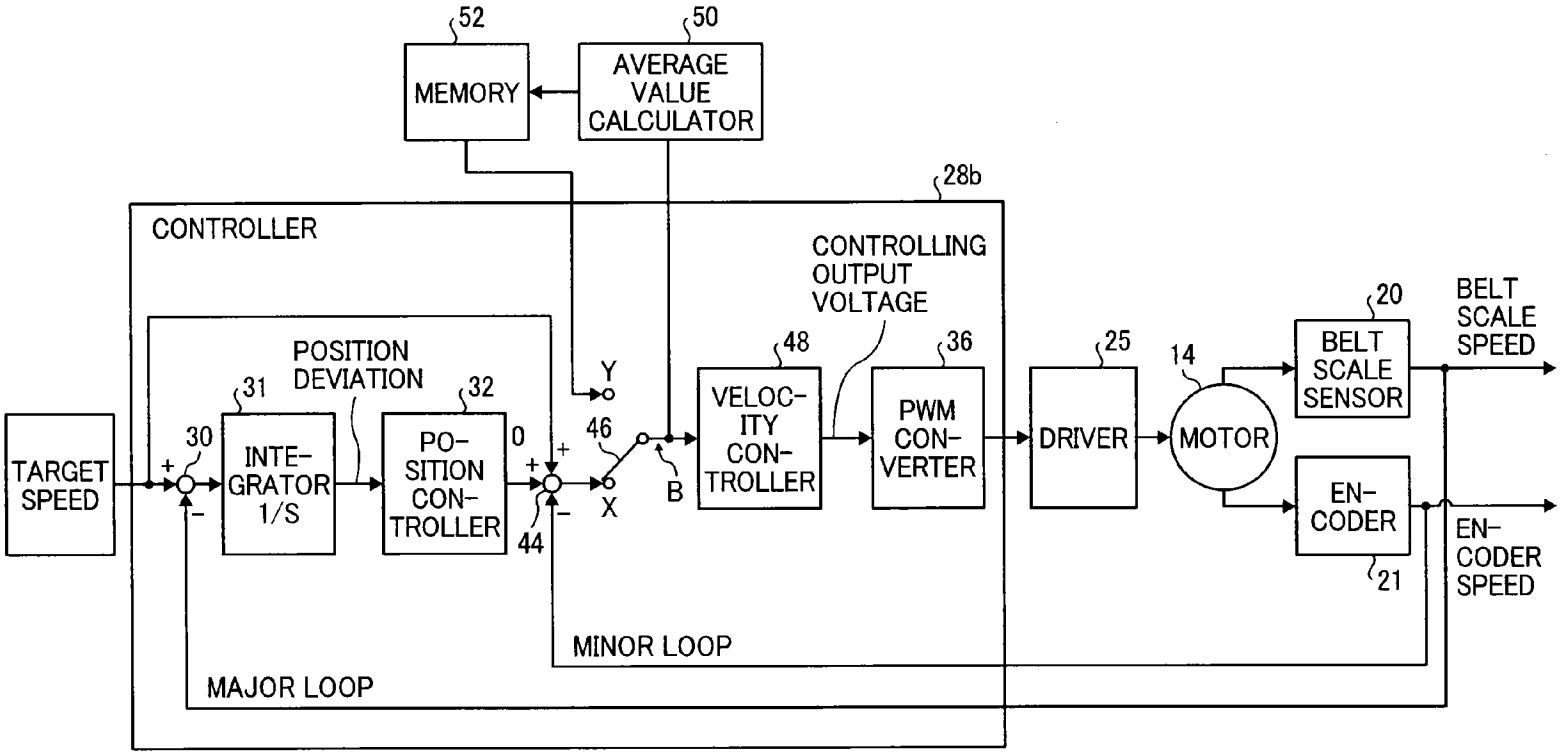
FIG. 8 is a functional block diagram showing an example of a controller together with various units of the image forming apparatus according to a second example of the present invention.

Next, a description will be given of an image forming apparatus of a second example of the present invention. FIG. 8 is a functional block diagram showing a controller 28*b* together with various units of the image forming apparatus according to a second example. The controller 28*b* corresponds to the controller 28 shown in FIG. 3, and includes the CPU 27. Incidentally, in FIG. 8, the same constituent parts as in FIG. 5 are referred to by the same numerals so that description of the parts will be omitted. Moreover, the structure and function of the elements of FIG. 8 may be implemented as the corresponding elements of FIG. 5.

The second comparator 44 receives the target speed, the detection of the encoder 21 (encoder speed), and the correction value which was calculated in the position controller 32 and calculates a velocity deviation. The second comparator 44 outputs the velocity deviation to the switching unit 46. When the belt scale sensor 20 is abnormal, the switching unit 46 switches the input terminal to Y from X.

The average value calculator 50 corresponds to the average value calculator 29 shown in FIG. 3, and calculates the average of the outputs B from the second comparator 44 for a predetermined period. The memory 52 corresponds to the memory 26 shown in FIG. 3, and stores the average value received from the average value calculator 50. When the belt scale sensor 20 is abnormal because of dirt, the switching unit 46 switches the input terminal from the X position used under a normal condition to the Y position used in an abnormal condition, and then the velocity controller 48 uses the data stored in the memory 42 as the velocity deviation.

The velocity controller 48 controls the output voltage output to the motor 14 corresponding to the velocity deviation from the switching unit 46 so that the surface speed of the intermediate transfer belt 19 approaches the target speed. Additionally, the velocity controller 48 may be implemented as a general controller which is designed based on a frequency response based on a motor input voltage, a signal from the encoder, and a signal from the belt scale sensor 20.

Figure 9:
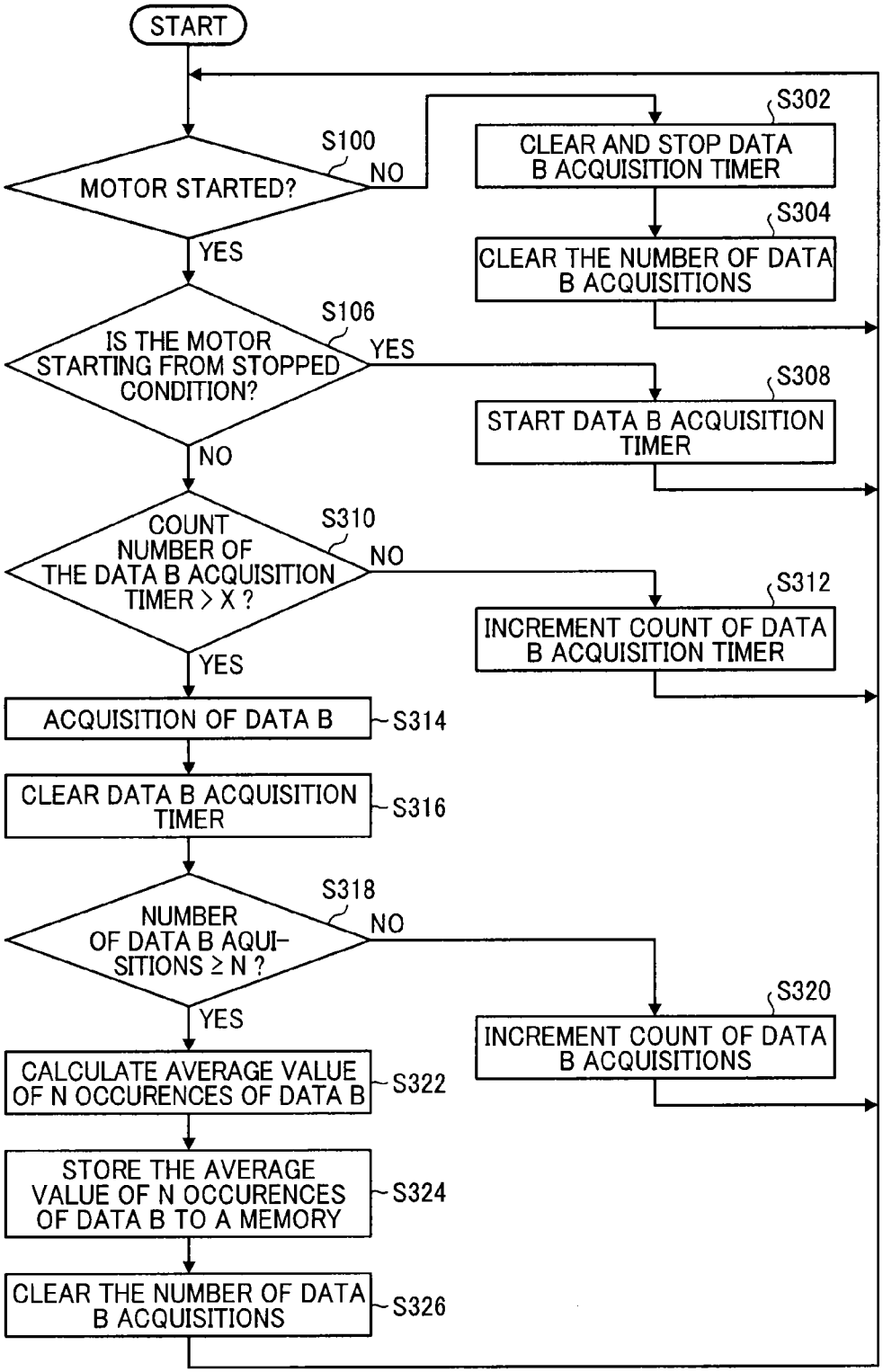
FIG. 9 is a flowchart showing an exemplary operation by the controller according to the second example of the present invention.

FIG. 9 is a flowchart showing an operation by the controller 28*b* of the image processing apparatus 100 according to a second example. Incidentally, in FIG. 9, the same processes as in FIG. 6 are referred to by the same numerals so that description of the processes will be omitted.

As shown in FIG. 9, the controller 28*b* determines if the motor 14 has started or is starting in step S100. When the motor has started or is starting (S100: Yes), the controller 28*b* performs step S106. When the motor does not start (S100: No), the controller 28*b* performs step S302.

In step S302, the controller 28*b* stops a data B acquisition timer which is used to acquire data B, and clears the data B acquisition timer. In step S304, the controller 28*b* clears the number of the data B acquisition.

In step S106, the controller 28*b* determines if the motor is starting from a stopped condition. When the motor is starting from a stopped condition (S106: Yes), the controller 28*b* performs step S308. When the motor is not starting from a stopped condition, that is, the motor 14 has started (S106: No), the controller 28*b* performs step S310. In step S308, the controller 28*b* starts the data B acquisition timer.

In step S310, the controller 28*b* determines if the count number of the data B acquisition timer exceeds X which corresponds to the predetermined period. When the controller 28*b* determines the count number of the data B acquisition timer exceeds the X (S310: Yes), the controller 28*b* performs step S314. When the controller 28*b* determines the count number of the data B acquisition timer does not exceed X (S310: No), the controller 28*b* performs step S312.

In step S312, the controller 28*b* causes the data B acquisition timer counts up. In step S314, the controller 28*b* acquires the data B. In step S316, the controller 28*b* clears the data B acquisition timer.

In step S318, the controller 28*b* determines if the number of data B acquisitions exceeds N which is predetermined. When the controller 28*b* determines the number of data B acquisition exceeds N (S318: Yes), the controller 28*b* performs step S322. When the controller 28*b* determines the number of data B acquisition does not exceed N (S318: No), the controller 28*b* performs step S320.

In step S320, the controller 28*b* causes the count of the number of data B acquisition to increase by one. In step S322, the controller 28*b* calculates the average value of data B. Additionally, the average value of data B is an example of a corresponding value of data B.

In step S324, the controller 28*b* stores the average value of data B to the data B storing area of the memory 52. In step S326, the controller 28*b* clears the number of data B acquisitions.

Additionally, the values of X and N can be arbitrarily set based on a condition of the intermediate transfer belt 19. The controller 28*b* repeats from step S100 to step S326.

Figure 10:
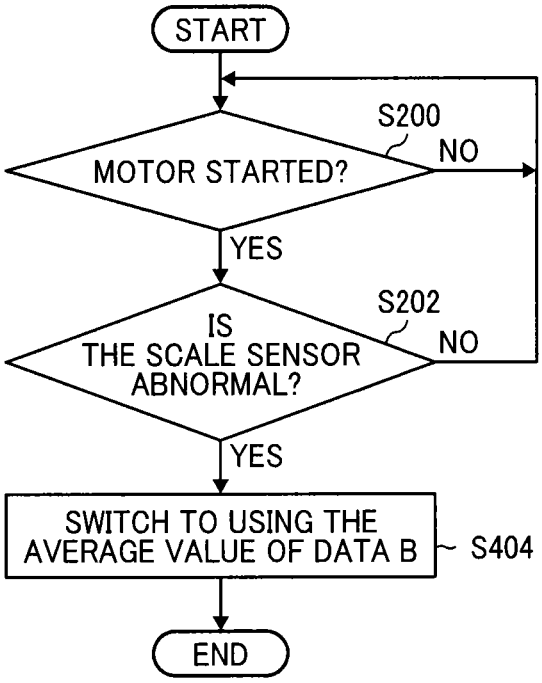
FIG. 10 is a flowchart showing an exemplary operation by the controller of the image forming apparatus according to the second example of the present invention when the belt scale sensor is abnormal.

FIG. 10 is a flowchart showing an operation by the controller 28*b* of the image forming apparatus 100 when a belt scale sensor 20 is abnormal. In FIG. 10, steps S200 and S202 are the same as the corresponding steps of FIG. 7, and the description of those steps is omitted.

In step S404, the controller 28*b* switches the switching unit 46 of FIG. 8 which is used for controlling the surface speed of the intermediate transfer belt 19 using the average value of data B. This enables the reduction of fluctuation of the surface speed of the intermediate transfer belt 19 because of thermal expansion of the driving roller 16 when the belt scale sensor 20 is abnormal and the detection of the encoder 21 is used.

Figures 11, 12A, 12B:
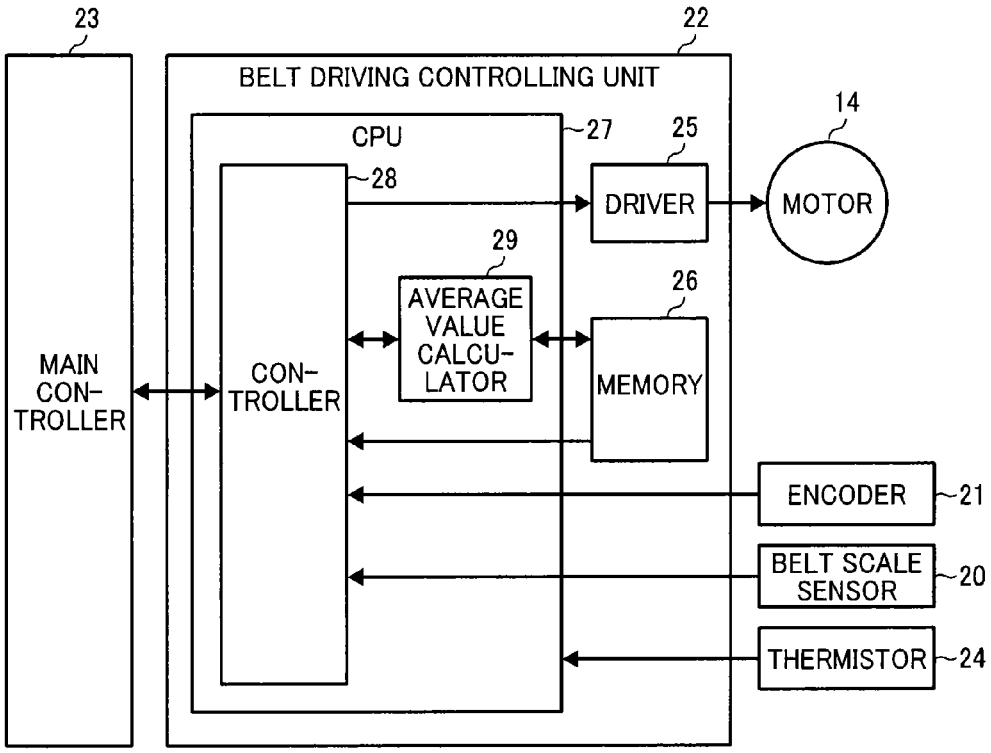
FIG. 11 is a functional block diagram showing an example of the belt driving controlling unit which controls the intermediate transfer belt together with various units of the image forming apparatus according to a modification example of the present invention.
FIGS. 12A and 12B are data tables stored in a memory according to a modification example of the present invention.

Next, a description is provided of a modified example of the present invention which uses the temperature information. FIG. 11 is a functional block diagram showing the belt driving controlling unit 22 which controls the intermediate transfer belt together with various units of the image forming apparatus according to a modified example. In FIG. 11, the same constituent parts as in FIG. 3 are referred to by the same numerals and a description of the corresponding parts is omitted. A thermistor 24 (a temperature detecting unit) is arranged near the driving roller 16, and detects the temperature around or surrounding the driving roller 16. The thermistor 24 outputs a signal based on the detected temperature to the CPU 27.

A description is provided of the controller 28*a* and the controller 28*b* which perform based on the signal from the thermistor 24. FIGS. 12A and 12B are illustrations showing how to store data in the memory and 52 (or the memory 26). FIG. 12A is an illustration showing addresses of the memory 42 when the controller 28*a* stores the average value of the data A. FIG. 12B is an illustration showing addresses of the memory 52 when the controller 28*b* stores the average value of the data B. In this way, the average value of the data A and the average value of the data B are stored to different areas corresponding to each temperature ranges.

Figure 13:
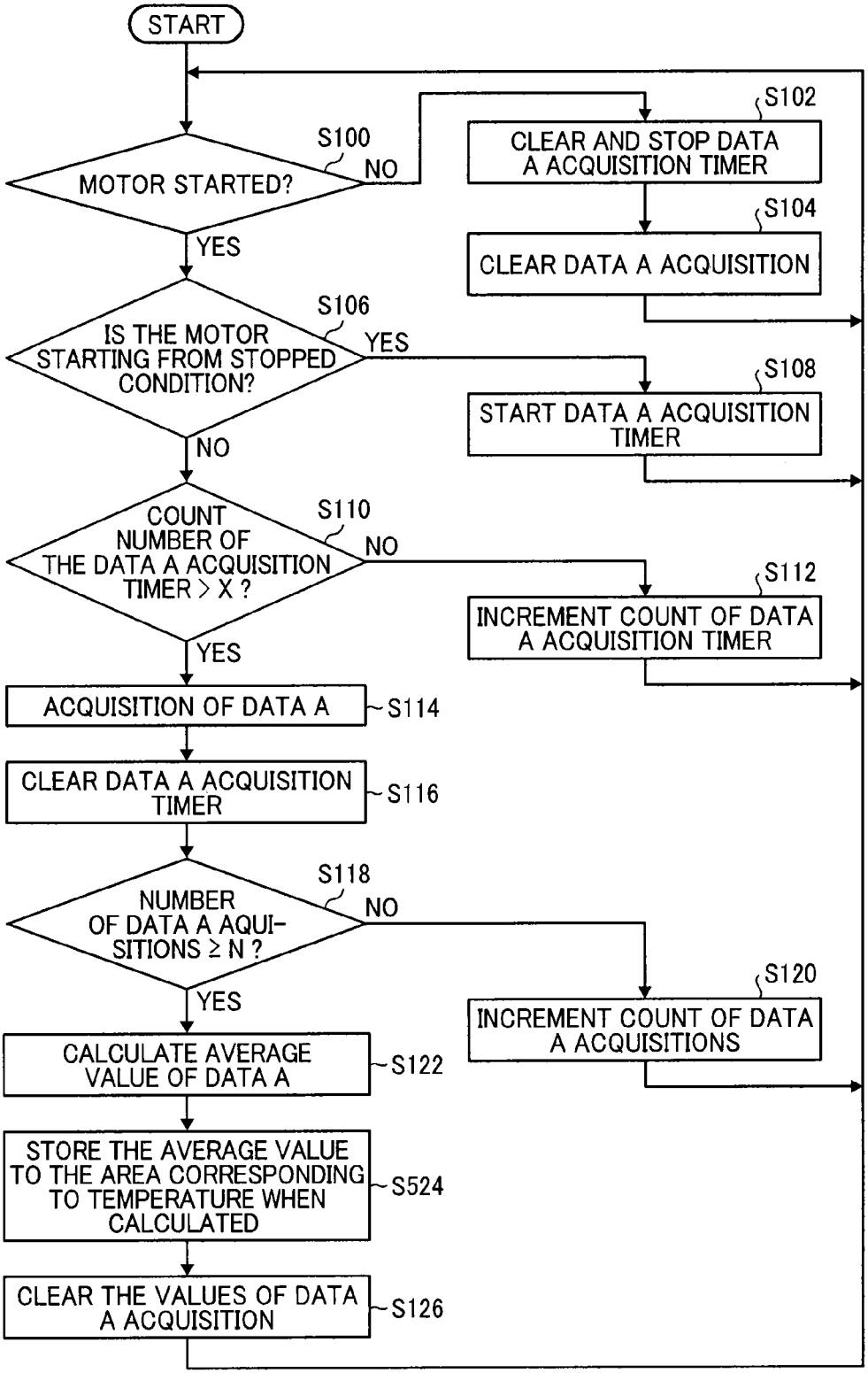
FIG. 13 is a flowchart showing an exemplary operation by the controller based on average value of data A corresponding to each temperature range according to a modified example of the first example of the present invention.

FIG. 13 is a flowchart showing an operation by the controller 28*a* based on the average of the data A corresponding to each temperature range according to a modified example of the first example. Incidentally, in FIG. 13, the same steps as those illustrated in FIG. 6 are referred to by the same numerals and a description of those steps is omitted.

In step S524, the controller 28*a* stores the average value of the data A to area of the memory 42 corresponding to temperature when the average value is calculated.

Figure 14:
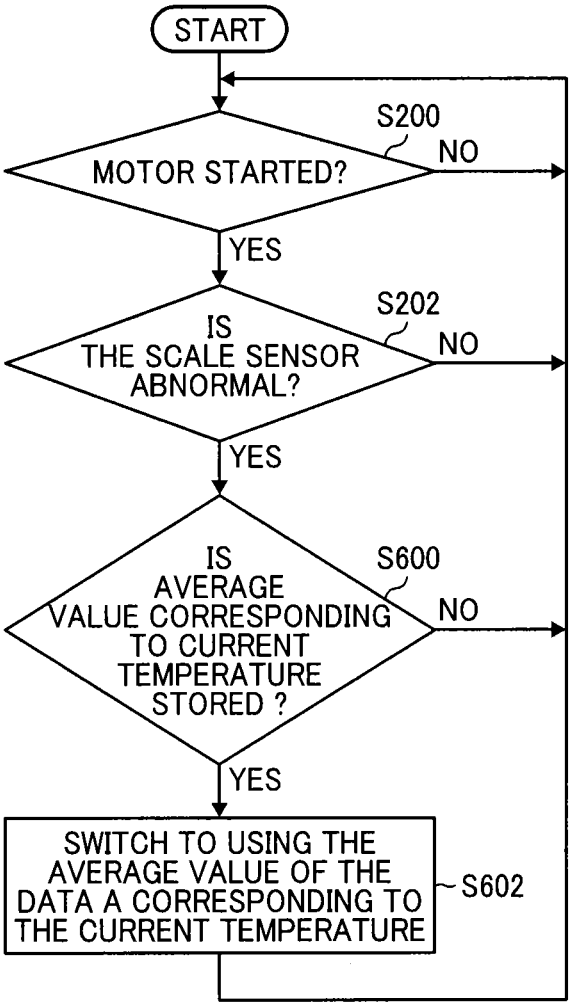
FIG. 14 is a flowchart showing an exemplary operation by the controller of the image forming apparatus according to the modified example of the first example of the present invention when the belt scale sensor is abnormal.

FIG. 14 is a flowchart showing an operation by the controller 28*a* according to the modified example of the first example of the present invention when the belt scale sensor 20 is abnormal. In FIG. 14, the same steps as in FIG. 7 are referred to by the same numerals and the description of those steps is omitted.

In step S600, the controller 28*a* determines if the average value of the data A is stored in the area of the memory 42 corresponding to the current temperature. When the controller 28*a* determines that the average value of the data A is stored in the area of the memory 42 corresponding to the current temperature (S600: Yes), the controller 28*a* performs step S602. When the controller 28*a* determines that the average value of the data A is not stored the area of the memory 42 corresponding to the current temperature (S600: No), the controller 28*a* performs the step S200.

In step S602, the controller 28*a* switches the switching unit 33 so as using the average of the data A corresponding to the current temperature. This enables the controller 28*a* to reduce the fluctuating of the surface speed of the intermediate transfer belt 19 when the belt scale sensor 20 is abnormal and the detection of encoder 21 is used, because the controller 28*a* can use the average value of the data A corresponding to the current temperature, that is, corresponding to the expansion level of the driving roller 16.

Additionally, when the controller 28*a* determines that the average value of the data A is not stored in the area of the memory 42 corresponding to current temperature, the controller 28*a* may use the average value of data A which is stored in the area of memory 42 corresponding to the temperature being close to the current temperature.

Figure 15:
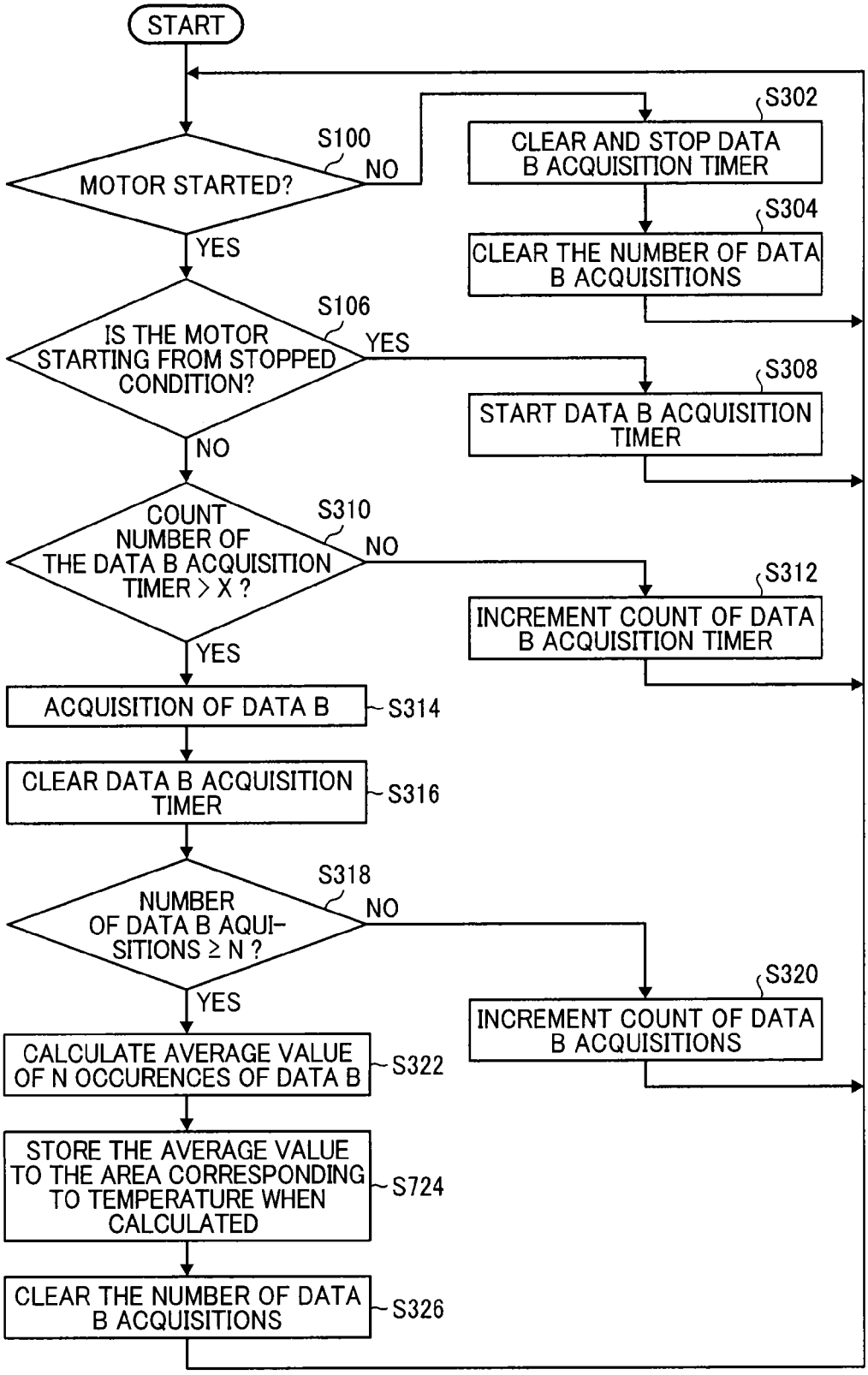
FIG. 15 is a flowchart showing an exemplary operation by the controller based on average value of data B corresponding to each temperature range according to a modification example of the second example of the present invention.

FIG. 15 is a flowchart showing an operation by the controller 28*b* based on average of the data B corresponding to each temperature range according to a modified example of the second example. In FIG. 15, the same steps as illustrated in FIG. 9 are referred to by the same numerals and a description of these steps is omitted.

In step S724, the controller 28*b* stores the average value of the data B to an area of the memory corresponding to temperature when the average value is calculated.

Figure 16:
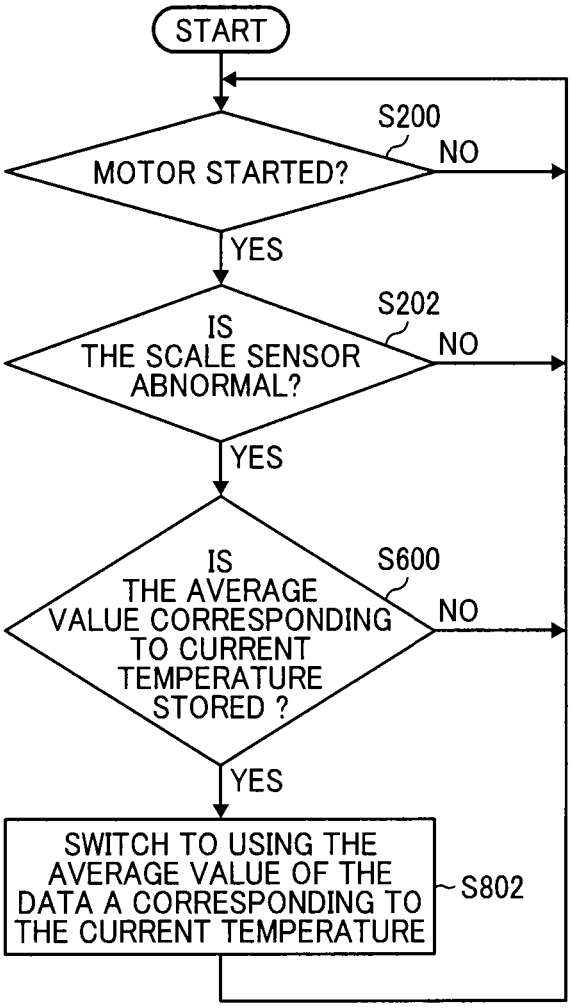
FIG. 16 is a flowchart showing an exemplary operation by the controller of the image forming apparatus according to the modified example of the second example of the present invention when the belt scale sensor is abnormal.

FIG. 16 is a flowchart showing an operation by the controller 28*b* according to a modified example of the second example of the present invention when the belt scale sensor 20 is abnormal. In FIG. 16, the same steps as illustrated in FIG. 10 are referred to by the same numerals and a description of these steps is omitted.

In step S600, the controller 28*b* determines if the average value of the data B is stored in the area of the memory 52 corresponding to current temperature. When the controller 28*b* determines that the average value of the data B is stored the area of the memory 52 corresponding to current temperature (S600: Yes), the controller 28*b* performs step S802. When the controller 28*b* determines that the average value of the data B is not stored the area of the memory 52 corresponding to current temperature (S600: No), the controller 28*b* performs the step S200.

In the step S802, the controller 28*b* switches the switching unit 46 to use the average of the data B corresponding to current temperature. This enables the controller 28*b* to reduce the fluctuation of the surface speed of the intermediate transfer belt 19 when the belt scale sensor 20 is abnormal and the detection of encoder 21 is used, because the controller 28*b* can use the average value of the data B corresponding to the current temperature, that is, corresponding to the expansion level of the driving roller 16.

Additionally, when the controller 28*b* determines that the average value of the data B is not stored the area of the memory 52 corresponding to the current temperature, the controller 28*b* may use the average value of data B which is stored in the area of memory 52 corresponding to the temperature which is close to current temperature.

Additionally, the memory 26 (the memory 42, the memory 52) and the average value calculator 29 (the average value calculator 40, the average value calculator 50) may be arranged in the image forming apparatus 100. When the DFE 12 is connected to the image forming apparatus 100, the memory and average value calculator may be arranged in the DFE 12, or one of them may be arranged in the DFE 12, the other may be arranged in the image forming apparatus 100. The each units of the controller 28 (the controller 28*a*, the controller 28*b*) may be configured in software, may be configured in hardware, or may be a combination of hardware and software.

In the foregoing description of the embodiments, a description was given that the corresponding value of data A or B is the average value of data A or B. However, the corresponding value may be another value. The belt conveyance apparatus is not limited to an apparatus including an intermediate transfer belt, may be an apparatus including a photoconductive belt which conveys an electrostatic latent image or a conveyance belt which conveys the sheet such as paper or a document or the like.

The invention may be implemented using one or more circuits or processing circuits. A circuit or processing circuit is a structural assemblage of electronic components including conventional circuit elements, integrated circuits including application specific integrated circuits, standard integrated circuits, application specific standard products, and field programmable gate arrays. Further a processing circuit includes central processing units, graphics processing units, and microprocessors which are programmed or configured according to software code. A circuit does not include pure software, although a circuit does includes the above-described hardware executing software.

The memories described herein may be implemented using any desired and appropriate technology including a RAM, ROM, SRAM, flash memory, semiconductor memory, a hard disk drive, or any other type of memory which is desired to be used.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. A belt conveyance apparatus, comprising:

a belt;

a driving roller to rotate and drive the belt;

a first sensor to directly detect a surface speed of the belt;

a second sensor to detect a rotation speed of the driving roller;

a first calculator to calculate a first deviation from a target speed based on the surface speed and the target speed;

a memory to store a correction value corresponding to the first deviation;

a second calculator to calculate a second deviation from the target speed corrected by the first deviation based on the target speed, the first deviation and the rotation speed of the driving roller;

a controller to control the rotation speed of the driving roller based on the second deviation; and a switch to switch the first deviation to be used for calculating the second deviation by the second calculator to the correction value stored in the memory when the controller judges that the first sensor is abnormal, wherein when the correction value stored in the memory is used by the second calculator after the switch switches the first deviation to the correction value, the second calculator calculates the second deviation from the target speed, the correction value, and the rotation speed of the driving roller.

2. The belt conveyance apparatus as in claim 1, further comprising:

a temperature detector to detect a temperature at the driving roller, wherein:

the memory stores a plurality of data values respectively corresponding to predetermined temperature ranges based on a temperature detected by the temperature detector, and the switch switches from the first deviation to one of the values stored in the memory based on the temperature detected by the temperature detector.

3. An image forming apparatus comprising the belt conveyance apparatus according to claim 1, wherein the belt conveys an electrostatic latent image, a toner image or a sheet.

4. An image forming system comprising an image forming apparatus and a memory to store a correction value corresponding to a first deviation, the image forming apparatus comprising:

a belt;

a driving roller to rotate and drive the belt;

a first sensor to directly detect a surface speed of the belt;

a second sensor to detect a rotation speed of the driving roller;

a first calculator to calculate the first deviation from a target speed based on the surface speed and the target speed;

a second calculator to calculate a second deviation from the target speed corrected by the first deviation based on the target speed, the first deviation and the rotation speed of the driving roller;

a controller to control the rotation speed of the driving roller based on the second deviation; and a switch to switch the first deviation to be used for calculating the second deviation by the second calculator to the correction value stored in the memory when the controller judges that the first sensor is abnormal, wherein when the correction value stored in the memory is used by the second calculator after the switch switches the first deviation to the correction value, the second calculator calculates the second deviation from the target speed, the correction value, and the rotation speed of the driving roller.

5. The image forming system as in claim 4, further comprising:

a temperature detector to detect a temperature at the driving roller, wherein:

the memory stores a plurality of data values respectively corresponding to predetermined temperature ranges based on a temperature detected by the temperature detector, and the switch switches from the first deviation to one of the values stored in the memory based on the temperature detected by the temperature detector.

* * * * *